US009429894B2

(12) United States Patent
Mashiki

(10) Patent No.: US 9,429,894 B2
(45) Date of Patent: Aug. 30, 2016

(54) PACKAGED IMAGE FORMING APPARATUS AND DIAGNOSTIC SYSTEM OF APPARATUS TO BE PACKAGED

(71) Applicant: KYOCERA Document Solutions Inc., Osaka-shi, Osaka (JP)

(72) Inventor: Masami Mashiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 6 days.

(21) Appl. No.: 14/011,852

(22) Filed: Aug. 28, 2013

(65) Prior Publication Data

US 2014/0064745 A1 Mar. 6, 2014

(30) Foreign Application Priority Data

Aug. 31, 2012 (JP) ..... 2012-190831

(51) Int. Cl.

| | |
|---|---|
| ***G03G 15/00*** | (2006.01) |
| ***G03G 21/16*** | (2006.01) |
| *G03G 15/20* | (2006.01) |

(52) U.S. Cl.

CPC ..... *G03G 15/80* (2013.01); *G03G 21/1652* (2013.01); *G03G 15/2003* (2013.01); *G03G 15/5079* (2013.01)

(58) Field of Classification Search

CPC ..... G03G 15/80; G03G 15/2003; G03G 21/1652; G03G 15/5079

See application file for complete search history.

(56) References Cited

U.S. PATENT DOCUMENTS 4,603,245 A * 7/1986 Yagasaki ..... G03G 15/2039 219/216
5,852,561 A * 12/1998 Chan ..... G06G 8/60 710/10
6,008,652 A * 12/1999 Theofanopoulos ..... G01R 31/3648 320/106
6,285,006 B1 * 9/2001 Hyllberg ..... H05B 3/0095 219/216
2002/0189971 A1 * 12/2002 Barker ..... B65D 5/54 206/723
2008/0143339 A1 * 6/2008 Iseki ..... G03G 15/55 324/523
2011/0236038 A1 * 9/2011 Saito ..... G03G 15/0855 399/13

FOREIGN PATENT DOCUMENTS

| | | | |
|---|---|---|---|
| CN | 201993430 | | 9/2011 |
| JP | 57-030850 | * | 2/1982 |
| JP | 09-146188 | * | 6/1997 |
| JP | 2006-8191 | | 1/2006 |
| JP | 2006-039939 | * | 2/2006 |

* cited by examiner

*Primary Examiner* — David Gray
*Assistant Examiner* — Laura Roth
(74) *Attorney, Agent, or Firm* — Gerald E. Hespos; Michael J. Porco; Matthew T. Hespos

(57) ABSTRACT

A packaged image forming apparatus includes an image forming apparatus, and a packaging member for packaging the image forming apparatus. The image forming apparatus includes a power supply connection unit to which one end of a power cable, the other end of which is connected to an external power source, is detachably connected, a power supply voltage generation unit receiving a voltage via the power cable and generating a power supply voltage, a load circuit operating based on the power supply voltage, a status determination unit determining whether a connection status of the load circuit is normal, and a communication interface unit sending a determination result to the external device. The packaging member includes an access part enabling the one end of the power cable to be connected to the power supply connection unit in a state where the image forming apparatus is packaged.

5 Claims, 4 Drawing Sheets

PACKAGED IMAGE FORMING APPARATUS AND DIAGNOSTIC SYSTEM OF APPARATUS TO BE PACKAGED

INCORPORATION BY REFERENCE

This application relates to and claims priority from Japanese Patent Application No. 2012-190831, filed on Aug. 31, 2012, the entire disclosure of which is incorporated herein by reference.

BACKGROUND

The present disclosure relates to a packaged image forming apparatus and a diagnostic system of an apparatus to be packaged including the packaged image forming apparatus, and particularly relates to technology of performing the verification of operations of a packaged image forming apparatus.

For instance, a product of an image forming apparatus such as a printer, after an inspection of an operation check satisfying the specification is completed, is packaged using a packaging member such as cardboard, and delivered in that packaged condition. Subsequently, at the place of delivery, the image forming apparatus is removed from the packaging member, and set up by a serviceman or the like.

Conventionally, for instance, known is a method of forming openings in the packaging material for packaging a projector in order to expose the power cable, computer connection cable, and projection part. In addition, known is a method where, in a state where the projector is packaged with the foregoing packaging material, the respective cables are inserted into the projector via the openings, and information of software or the like in the projector is rewritten from an external computer connected to the computer connection cable. Furthermore, known is a method of confirming whether the information was rewritten normally by outputting an image from the projection part via the opening formed in the packaging material.

Nevertheless, due to the vibration or shock during the transport, there are cases where the components connected to the connector inside the device come off or the solder connection becomes defective and the connection status of circuits inside the device becomes abnormal. Consequently, there was a possibility that the device would not operate during the setup operation.

In the foregoing case, it is not possible to determine whether the information was not rewritten properly or whether there is an abnormality in the connection status of the circuits inside the device. Moreover, if the packaged device is a projector, an operation check can be performed using the opening that is provided at a position corresponding to the projection part of the packaging material. However, in the case of an image forming apparatus in which the packaged device needs to be operated upon setting a document or paper thereon, it is difficult to perform an operation check by actually operating the device in a packaged state.

An object of the present disclosure is to perform the operation check of an image forming apparatus in a state where the image forming apparatus is still packaged.

SUMMARY

The packaged image forming apparatus according to one aspect of the present disclosure includes an image forming apparatus, and a packaging member for packaging the image forming apparatus. The image forming apparatus includes a power supply connection unit, a power supply voltage generation unit, a load circuit, a status determination unit and a communication interface unit. One end of a power cable, the other end of which is connected to an external power source, is detachably connected to the power supply connection unit. The power supply voltage generation unit receives a voltage supplied from the external power source via the power cable connected to the power supply connection unit and generates a power supply voltage. The load circuit operates by being supplied with the power supply voltage. The status determination unit determines whether a connection status of the load circuit is normal. The communication interface unit sends a determination result of the status determination unit to the external device provided outside the packaged image forming apparatus. The packaging member includes an access part enabling the one end of the power cable to be connected to the power supply connection unit in a state where the image forming apparatus is packaged.

DETAILED DESCRIPTION

Figure 1:
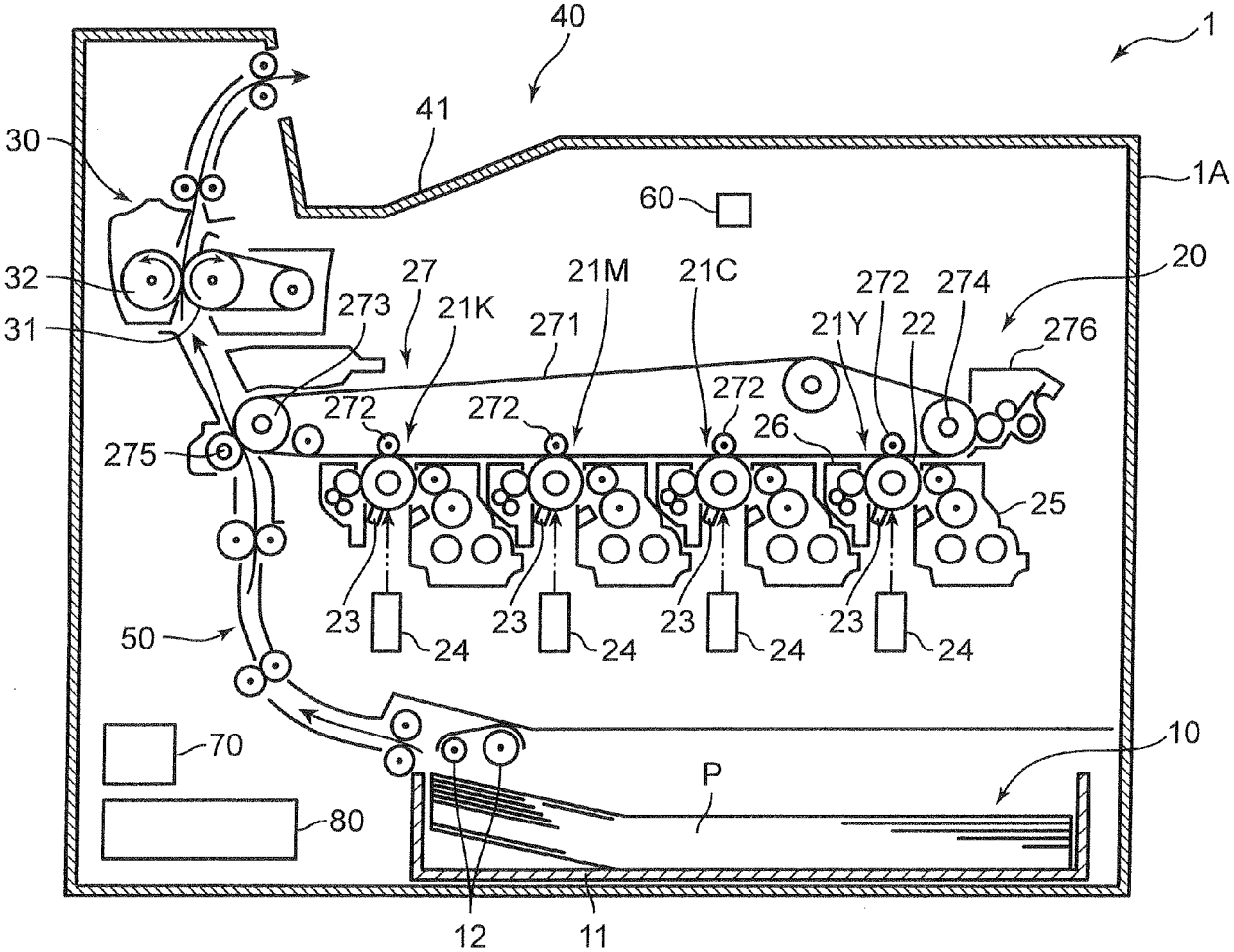
FIG. 1 is a schematic configuration diagram of a color printer according to an embodiment of the image forming apparatus of the present disclosure.

An embodiment according to the present disclosure is now explained with reference to the drawings. FIG. 1 is a schematic configuration diagram of a color printer 1 according to an embodiment of the image forming apparatus of the present disclosure.

As shown in FIG. 1, the color printer 1 comprises a paper storage part 10, an image forming unit 20, a fixation unit 30, a paper discharge part 40, a paper conveying unit 50, a temperature sensor (temperature detection unit) 60, a communication interface unit 70, and a control unit 80. The paper discharge part 40 is provided at the apex of the apparatus main body 1A, and each of the other parts is mounted within the apparatus main body 1A.

The paper storage part 10 stores paper P, and supplies and feeds the paper P based on the control of the control unit 80. The paper storage part 10 comprises a paper cassette 11 which is insertable to and detachable from the apparatus main body 1A. The upstream end of the paper cassette (upper left of the paper cassette 11 in the example shown in FIG. 1) is provided with a pickup roller 12 for supplying one sheet of paper P at a time from the paper bundle. The paper P supplied from the paper cassette 11 based on the drive of the pickup roller 12 is fed to the paper conveying unit 50.

The image forming unit 20 performs transfer processing of an image to the paper P supplied from the paper bundle stored in the paper storage part 10 based on the image data received from an external personal computer or the like under the control of the control unit 80.

The image forming unit 20 comprises image forming units 21Y, 21C, 21M, 21K of the respective colors for forming a toner image, and a transfer device 27 for transferring, to the paper P, the toner image formed by the image forming units 21Y, 21C, 21M, 21K.

The image forming units 21Y, 21C, 21M, 21K are disposed substantially in the horizontal direction from the upstream side (right side in FIG. 1) toward the downstream side. The uppermost stream-side is the yellow image forming unit 21Y, and the cyan image forming unit 21C, the magenta image forming unit 21M, and the black image forming unit 21K are subsequently disposed in that order toward the downstream side. The respective image forming units 21Y, 21C, 21M, 21K are configured in the same manner.

The respective image forming units 21Y, 21C, 21M, 21K each comprise a photoreceptor drum (photoreceptor) 22, a charger 23, an optical scanning device 24, a developing device 25, and a cleaning device 26.

The photoreceptor drum 22 is rotatable about the drum axis extending in the front-back direction (direction that is orthogonal to the plane of paper of FIG. 1). The charger 23, the optical scanning device 24, the developing device 25 and the cleaning device 26 are disposed, in that order, from a position that is immediately below the photoreceptor drum 22 along the peripheral face of the photoreceptor drum 22 in a counterclockwise direction, which is the rotating direction of the photoreceptor drum 22.

The photoreceptor drum 22 comprises a peripheral face on which an electrostatic latent image, and a toner image according to the electrostatic latent image, are formed.

The charger 23 charges the peripheral face of the photoreceptor drum 22, which is rotating in a counterclockwise direction about the drum axis, with a uniform charge. The charger 23 includes a charge roller which applies a charge to the photoreceptor drum 22 while a peripheral face thereof is drivenly rotated in a manner of being in contact with the peripheral face of the photoreceptor drum 22.

The developing device 25 supplies a toner to the peripheral face of the photoreceptor drum 22. The toner supplied as described above adheres to the electrostatic latent image of the peripheral face of the photoreceptor drum 22, and a toner image is consequently formed on the peripheral face of the photoreceptor drum 22. Note that a yellow (Y) toner is housed in the developing device 25 of the yellow image forming unit 21Y, a cyan (C) toner is housed in the developing device 25 of the cyan image forming unit 21C, a magenta (M) toner is housed in the developing device 25 of the magenta image forming unit 21M, and a black (K) toner is housed in the developing device 25 of the black image forming units 21K.

The cleaning device 26 performs cleaning of the toner that is remaining on the peripheral face of the photoreceptor drum 22 after the primary transfer described later. The peripheral face of the photoreceptor drum 22 that was cleaned by the cleaning device 26 heads once again to the charger 23 for the subsequent image forming processing.

The optical scanning device 24 causes the peripheral face of the rotating photoreceptor drum 22 to be irradiated with a dynamic laser beam based on image data. The irradiation position is between the charger 23 and the developing device 25. Based on the irradiation of the laser beam, an electrostatic latent image is formed on the peripheral face of the photoreceptor drum 22.

The respective optical scanning devices 24 in the respective image forming units 21Y, 21C, 21M, 21K cause the respective photoreceptor drums 22 in the respective image forming units 21Y, 21C, 21M, 21K to be irradiated with a laser beam corresponding to the respective colors of cyan, magenta and black. When the peripheral face of the uniformly charged photoreceptor drum 22 is irradiated with a laser beam, the charge of the irradiated portion is erased according to the intensity of the laser beam. An electrostatic latent image is thereby formed on the peripheral face of the photoreceptor drum 22.

The transfer device 27 is a device for transferring, onto the paper P, the toner image formed on the peripheral face of the photoreceptor drum 22. The transfer device 27 comprises an intermediate transfer belt 271, a primary transfer roller 272, a drive roller 273, a driven roller 274 and a secondary transfer roller 275.

The intermediate transfer belt 271 is an endless belt, and is stretched at a position immediately above the respective image forming units 21Y, 21C, 21M, 21K by the primary transfer roller 272, the drive roller 273 and the driven roller 274. The intermediate transfer belt 271 is rotatable in the clockwise direction based on the rotational driving force of the drive roller 273.

The respective primary transfer rollers 272 are disposed to face the respective photoreceptor drums 22 of the respective image forming units 21Y, 21C, 21M, 21K. The intermediate transfer belt 271 is prevented from floating from the photoreceptor drum 22 by the respective primary transfer rollers 272 pressing the intermediate transfer belt 271. A primary transfer bias is applied to the respective primary transfer rollers 272. When a primary transfer bias is applied to the primary transfer roller 272, the toner image formed on the peripheral face of the photoreceptor drum 22 is primary-transferred to the intermediate transfer belt 271.

The secondary transfer roller 275 is disposed at a position facing the drive roller 273 at the outer peripheral face of the intermediate transfer belt 271. A secondary transfer bias is applied to the secondary transfer roller 275. When a secondary transfer bias is applied to the secondary transfer roller 275, the toner image that was primary-transferred to the intermediate transfer belt 271 is secondary-transferred to the paper P.

An intermediate transfer belt cleaning device 276 is provided to the right side, in the diagram, of the driven roller 274. The toner remaining on the surface of the intermediate transfer belt 271 after the toner image was secondary-transferred to the paper P is removed by the intermediate transfer belt cleaning device 276. Consequently, the surface of the cleaned intermediate transfer belt 271 heads toward the photoreceptor drum 22.

The fixation unit 30 performs fixation processing, via heating, to the paper P including the secondary-transferred toner image. The fixation unit 30 comprises a heat roller 31, and a pressure roller 32 placed opposite to the heat roller 31 such that their peripheral faces face each other. The heat roller 31 internally houses a conductive heating element which generates heat as a result of a current flowing therethrough. The paper P that was subject to the secondary transfer is then subject to the fixation processing by receiving heat from the heat roller 31 as a result of passing through a nip part between the heat roller 31 that is drivenly rotated about the roller axis in the clockwise direction and the pressure roller 32 that is driven-rotated about the roller in the counterclockwise direction. The paper P that was subject to the fixation processing is discharged to the paper discharge part 40 by the paper conveying unit 50.

The paper discharge part 40 receives and stores the paper P that was subject to the fixation processing with the fixation unit 30 and subsequently discharged. The paper discharge part 40 is formed by the apex of the apparatus main body 1A being recessed. A paper discharge tray 41 for receiving the discharged paper P is formed at the bottom of the recessed concave part.

The paper conveying unit 50 conveys, based on the control of the control unit 80, the paper P supplied from the paper storage part 10 to the paper discharge part 40 via the image forming unit 20 and the fixation unit 30.

The temperature sensor 60 is disposed inside the apparatus main body 1A, and detects the temperature inside the color printer 1. The temperature sensor 60 comprises, for example, a thermistor in which the resistance value changed according to the temperature. The resistance value of the thermistor changes according to the detected temperature when a power supply voltage described later is supplied. Consequently, the temperature sensor 60 outputs a load voltage in which the voltage value changes according to the detected temperature.

Note that the range that the voltage value of the load voltage changes is predetermined, for example, according to the temperature range of the object to be detected by the temperature sensor 60 based on test results of test operations, and stored in a ROM or the like.

The communication interface unit 70 is connected to an external device such as a personal computer via a local area network (LAN), internet or the like. The communication interface unit 70 is a communication interface circuit which sends and receives various types of data, such as image data, to and from the external device. The communication interface unit 70 performs wired communication by using a communication cable such as a 10/100 Base-TX.

The control unit 80 is connected to the paper storage part 10, the image forming unit 20, the fixation unit 30, the paper conveying unit 50, the temperature sensor 60 and the like, and governs the control of the operation of these components. The control unit 80 is configured by comprising on a circuit board, for example, a central processing unit (CPU), a read only memory (ROM) for pre-storing various programs to be executed by the CPU and data required for such execution, a readable and rewritable random access memory (RAM) for temporarily storing data, and peripheral circuits thereof.

Figure 2:
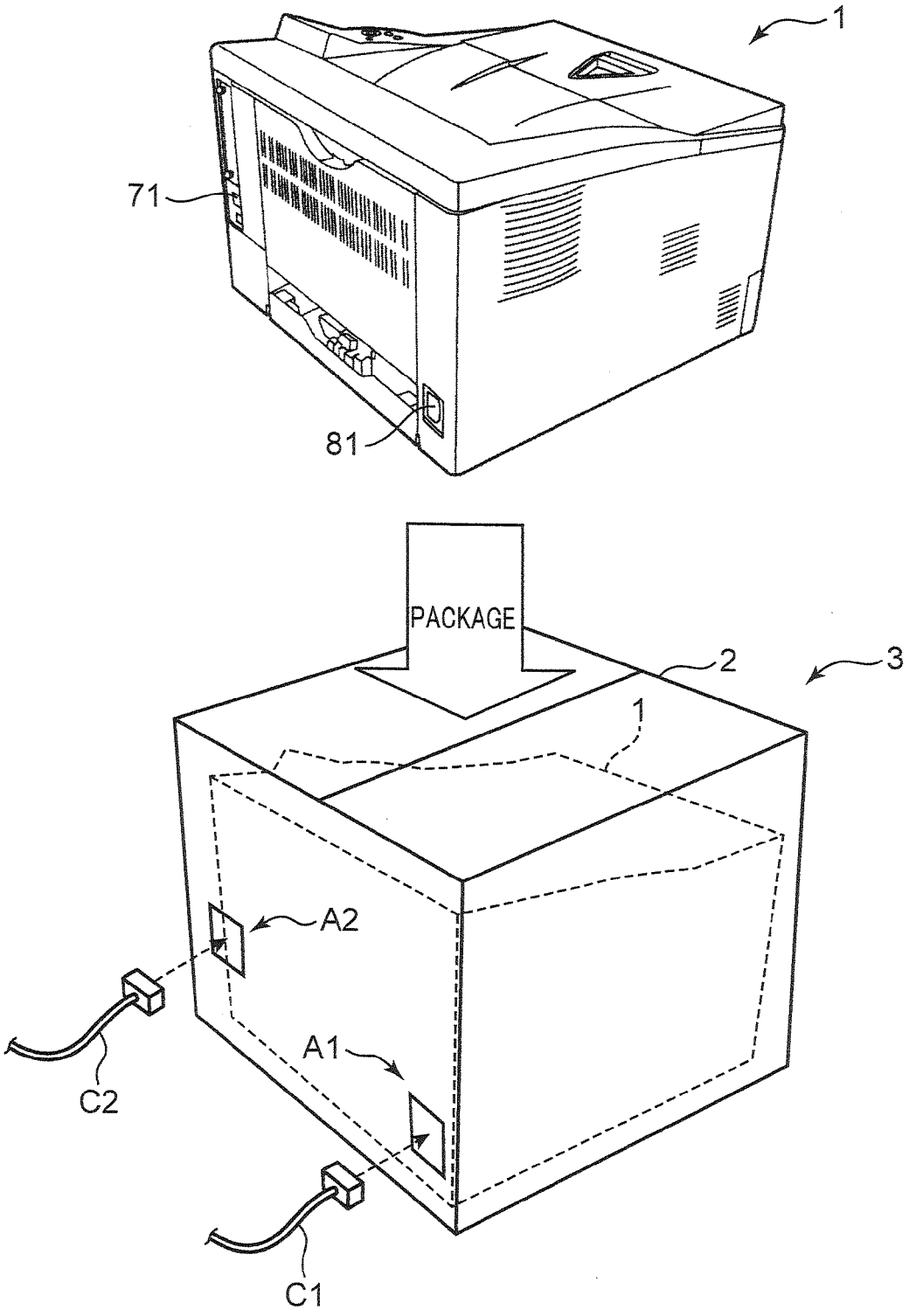
FIG. 2 is a schematic configuration diagram of a packaged image forming apparatus according to an embodiment of the packaged image forming apparatus of the present disclosure.

FIG. 2 is a schematic configuration diagram of the packaged image forming apparatus 3 according to an embodiment of the packaged image forming apparatus of the present disclosure. For example, as shown in FIG. 2, the packaged image forming apparatus 3 is configured by packaging the color printer 1 in a packaging box (packaging member) 2 configured from a packaging member such as a cardboard. Note that the packaging member for packaging the color printer 1 may also be, for example, a film-like packaging member for packaging (wrapping) the color printer 1, and may also be a different packaging member.

The packaging box 2 includes an access part A1 for connecting a power cable C1 to the color printer 1 in a state where the color printer 1 is packaged, and an access part A2 for connecting a communication cable C2 to the color printer 1 in a state where the color printer 1 is packaged.

Specifically, the access parts A1, A2 are formed by forming holes in the packaging box 2 at positions corresponding to the power cable connection unit (power supply connection unit) 81 and the communication cable connection unit 71 of the color printer 1 in a state of being packaged by the packaging box 2. However, the access parts A1, A2 are not limited to the foregoing mode, and may also be formed in the shape of openable/closable doors. In addition, the mode may also be such that the access parts A1, A2 are opened only upon connecting the power cable C1 and the communication cable C2 to the color printer 1, and such that the access parts A1, A2 are closed when the power cable C1 and the communication cable C2 are not connected to the color printer 1. Otherwise, the openings may be covered with removable cover members.

Figure 3:
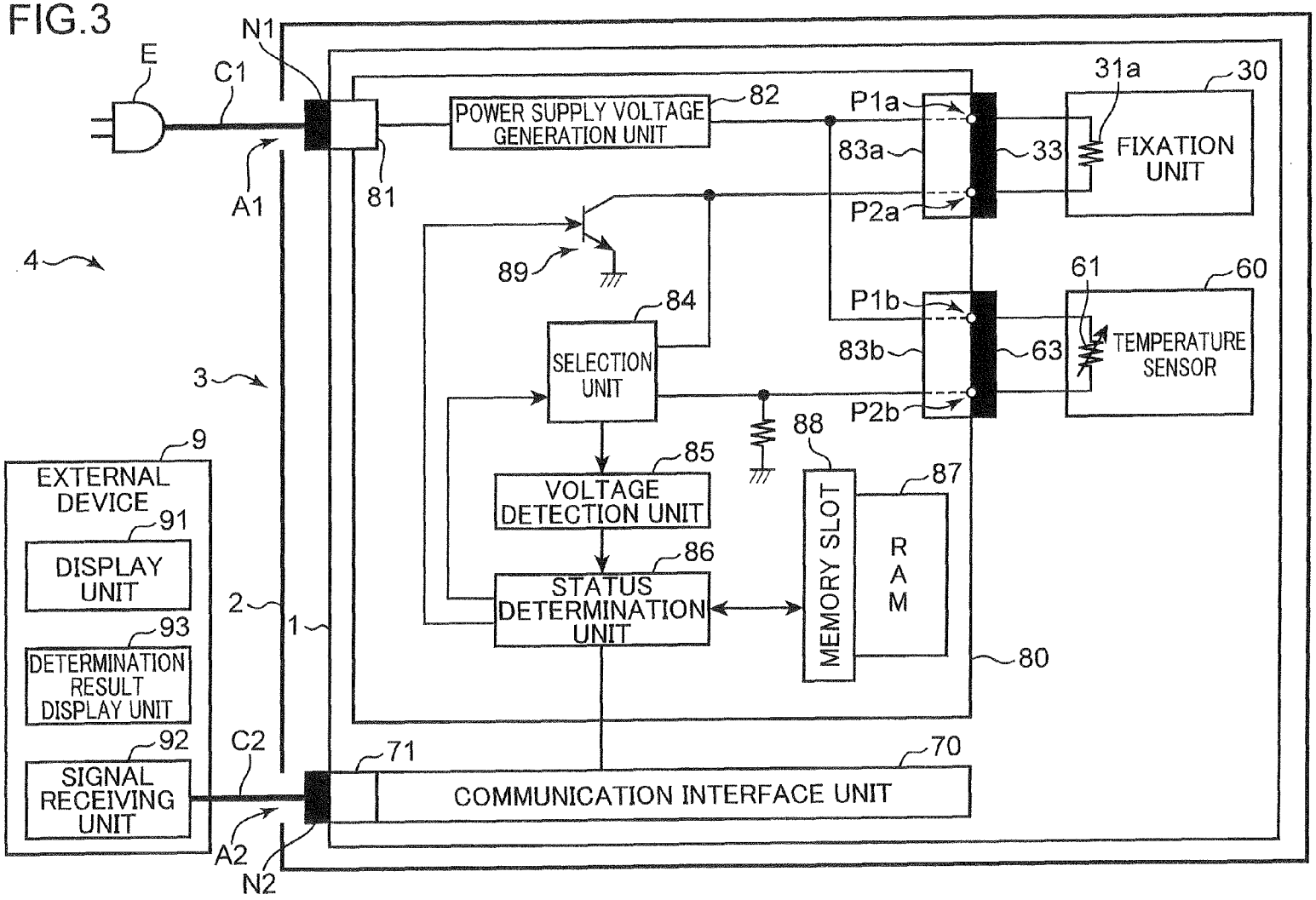
FIG. 3 is a block diagram showing the electric configuration of a diagnostic system of an apparatus to be packaged according to an embodiment of the diagnostic system of an apparatus to be packaged of the present disclosure.

In the ensuing explanation, explained is a diagnostic system of an apparatus to be packaged which determines whether the connection status of the load circuit in the color printer 1 is normal by using the packaged image forming apparatus 3. FIG. 3 is a block diagram showing the electrical configuration of the diagnostic system of an apparatus to be packaged 4 according to an embodiment of the diagnostic system of an apparatus to be packaged of the present disclosure. In the ensuing explanation, the explanation of the components that are given the same reference numeral as the components in FIG. 1 and FIG. 2 is omitted unless specifically mentioned.

As shown in FIG. 3, the diagnostic system of an apparatus to be packaged 4 includes a packaged image forming apparatus 3 in which the color printer 1 is packaged by the packaging box 2, and an external device 9.

The control unit 80 in the color printer 1 comprises a power cable connection unit 81, a power supply voltage generation unit 82, connectors (main body-side connectors) 83*a*, 83*b*, a switch unit 89, a selection unit 84, a voltage detection unit 85, a status determination unit 86, a RAM (memory) 87 capable of reading and rewriting information, and a memory slot 88 to which the RAM 87 is detachably connected.

A connector N1 provided to another end of the power cable C1 in which one end thereof is connected to an external power source E is detachably connected to the power cable connection unit 81, via the access part A1 of the packaging box 2.

The power supply voltage generation unit 82 comprises, for example, a switching power supply circuit. The power supply voltage generation unit 82 receives a voltage supplied from the external power source E via the power cable C1 connected to the power cable connection unit 81. The power supply voltage generation unit 82 generates a power supply voltage by converting the received voltage into a voltage of a predetermined voltage level. The CPU not shown provided to the control unit 80 is operated by using the power supply voltage generated by the power supply voltage generation unit 82.

The connector 83*a* comprises a power feeding terminal P1*a* for supplying, to the fixation unit 30, the power supply voltage generated by the power supply voltage generation unit 82, and a power receiving terminal P2*a* for receiving a load voltage according to the power supply voltage output from the fixation unit 30 as a result of being supplied with the power supply voltage. The power receiving terminal P2*a* is connected to a ground terminal of the fixation unit 30. The power receiving terminal P2*a* is connected to one end on the ground side of the conductive heating element 31*a* mounted inside the heat roller 31 (FIG. 1). A connector 33 connected to the fixation unit 30 is detachably connected to the connector 83*a*.

Similarly, the connector 83*b* comprises a power feeding terminal P1*b* for supplying, to the temperature sensor 60, the power supply voltage generated by the power supply voltage generation unit 82, and a power receiving terminal P2*b* for receiving a load voltage according to the power supply voltage output from the temperature sensor 60 as a result of being supplied with the power supply voltage. The load voltage shows the temperature detected by the temperature sensor 60. The power receiving terminal P2*b* is connected to one end on the ground side of the thermistor 61 provided inside the temperature sensor 60. The connector 63 connected to the temperature sensor 60 is detachably connected to the connector 83*b*.

The control unit 80 further comprises a plurality of connectors not shown to which are detachably connected the respective connectors connected to the respective drive units of the paper storage part 10, the image forming unit 20 and the like inside the color printer 1. In the ensuing explanation, the operation of determining the connection status of the two connectors 83*a*, 83*b* is explained as a representative example among the plurality of connectors.

Note that the fixation unit 30 and the temperature sensor 60 are both load circuits for outputting a load voltage according to the power supply voltage as a result of being supplied with the power supply voltage generated by the power supply voltage generation unit 82. Thus, in the ensuing explanation, when the fixation unit 30 and the temperature sensor 60 are explained collectively, they are collectively referred to as the "load circuit".

The switch unit 89 is a switch circuit for switching between whether to pass an electric current between the power receiving terminal P2*a* of the connector 83*a* and the ground based on a command from the status determination unit 86 described later.

The selection unit 84 is configured, for example, from a selector circuit. The selection unit 84 selects one load voltage designated by the status determination unit 86 described later of the load voltage output from the fixation unit 30 and received by the power receiving terminal P2*a* and the load voltage output from the temperature sensor 60 and received by the power receiving terminal P2*b*. In addition, the selection unit 84 outputs the selected load voltage to the voltage detection unit 85 described later.

The voltage detection unit 85 detects the voltage value of the load voltage selected by the selection unit 84, and outputs a detection signal indicated by the detected voltage value to the status determination unit 86.

The CPU configures the status determination unit 86 by executing the control program stored in the ROM or the like. The status determination unit 86 executes the processing explained below. Specifically, the status determination unit 86 determines whether the connector 33 connected to the fixation unit 30 is electrically connected, normally, to the connector 83*a* based on the load voltage detected by the voltage detection unit 85 when the power supply voltage is generated by the power supply voltage generation unit 82 and the generated power supply voltage is thereafter being supplied to the fixation unit 30 by the power feeding terminal P1*a*.

Moreover, the status determination unit 86 determines whether the connector 63 connected to the temperature sensor 60 is electrically connected, normally, to the connector 83*b* based on the load voltage detected by the voltage detection unit 85 when the power supply voltage generated by the power supply voltage generation unit 82 is being supplied to the temperature sensor 60 by the power feeding terminal P1*b*.

Figure 4:
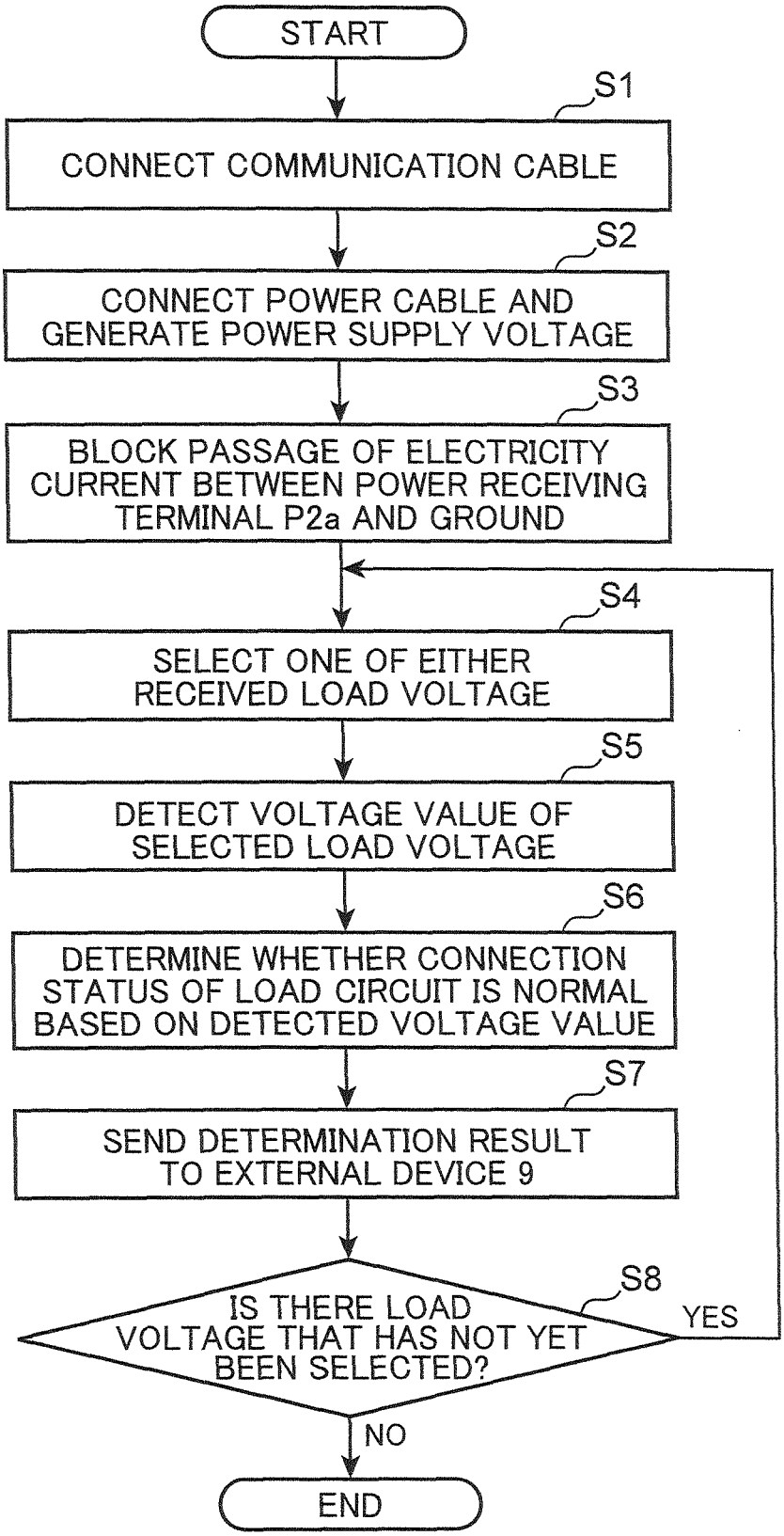
FIG. 4 is a flowchart showing the operation of the status determination unit for determining whether the connection status of the load circuit is normal.

FIG. 4 is a flowchart showing the operation of the status determination unit 86 for determining whether the connection status of the load circuit is normal.

As shown in FIG. 4, for example, a worker such as a serviceman connects, to the communication cable connection unit 71, the connector N2 (FIG. 3) provided to one end of the communication cable C2 via the access part A2 of the packaging box 2 in a state where the color printer 1 is packaged by the packaging box 2 (step S1). Moreover, the worker connects, to the power cable connection unit 81, the connector N1 provided to one end of the power cable C1 via the access part A1 of the packaging box 2 in a state where the color printer 1 is packaged by the packaging box 2. Consequently, the power supply voltage is generated by the power supply voltage generation unit 82 in a state where the color printer 1 is packaged by the packaging box (step S2).

Subsequently, the status determination unit 86 sends a control signal to the switch unit 89 for commanding switching so that an electric current does not pass between the power receiving terminal P2*a* and the ground. Based on the foregoing command, the switch unit 89 performs switching so that an electric current does not pass between the power receiving terminal P2*a* and the ground (step S3). In other words, the status determination unit 86 prevents a current from flowing to the conductive heating element 31*a* mounted inside the heat roller 31 provided to the fixation unit 30 when a power supply voltage is supplied to the fixation unit 30 via the power feeding terminal P1*a*. It is thereby possible to alleviate the possibility of the conductive heating element 31*a* generating heat.

Subsequently, the status determination unit 86 sends a control signal to the selection unit 84 for commanding selection of one of either the load voltage received by the power receiving terminal P2*a* or the load voltage received by the power receiving terminal P2*b*. The selection unit 84 selects one load voltage according to the command indicated by the control signal, and outputs the selected load voltage to the voltage detection unit 85 (step S4).

For example, the status determination unit 86 sends, in step S4, a control signal to the selection unit 84 for commanding selection of the load voltage received by the power receiving terminal P2*a*. The selection unit 84 selects the load voltage received by the power receiving terminal P2*a* according to the command indicated by the control signal, and outputs the selected load voltage to the voltage detection unit 85.

The voltage detection unit 85 detects the voltage value of the load voltage output in step S4, and outputs, to the status determination unit 86, a detection signal indicating the detected voltage value (step S5).

The status determination unit 86 determines whether the connector connected to the load circuit that output the load voltage selected in S4 is electrically connected, normally, to the connector corresponding to that load circuit in the control unit 80 based on the voltage value indicated by the detection signal output from the voltage detection unit 85 (step S6). The communication interface unit 70 sends the control signal indicating the determination result of step S6 to the external device 9 via the communication cable C2 connected to the communication cable connection unit 71 (step S7).

For example, in step S4, let it be assumed that the load voltage received by the power receiving terminal P2*a* is selected; that is, let it be assumed that the load voltage output from the fixation unit 30 is selected. In the foregoing case, the status determination unit 86 determines, in step S6, whether the connector 33 connected to the fixation unit 30 is electrically connected, normally, to the connector 83*a* corresponding to the fixation unit 30 in the control unit 80 by determining whether the voltage value indicated by the detection signal output from the voltage detection unit 85 exceeds a predetermined voltage value.

Note that the predetermined voltage value is pre-set to a voltage value that is not greater than the voltage value of the power supply voltage by giving consideration to the voltage drop caused by the wiring of the fixation unit 30 when the power supply voltage is supplied to the fixation unit 30 and when the fixation unit 30 is not in a conducting state.

In the foregoing case, the status determination unit determines that the connector 33 connected to the fixation unit 30 is electrically connected, normally, to the connector 83*a* upon determining that the voltage value indicated by the detection signal output from the voltage detection unit 85 has exceeded the predetermined voltage value. Meanwhile, the status determination unit 86 determines that the connector 33 connected to the fixation unit 30 is not electrically connected, normally, to the connector 83*a* upon determining that the voltage value indicated by the detection signal output from the voltage detection unit 85 has not exceeded the predetermined voltage value.

The communication interface unit 70 sends to the external device 9, in step S7, a control signal indicating that the determination result on whether the connector 33 connected to the fixation unit 30 is electrically connected, normally, to the connector 83*a*, via the communication cable C2 connected to the communication cable connection unit 71.

In step S4, when there is a load voltage that has not been selected by the selection unit 84 (S8; YES), the status determination unit 86 repeats step S4, and causes the selection unit 84 to select one load voltage among the non-selected load voltages.

For example, let it be assumed that a load voltage received by the power receiving terminal P2*a* in step S4 that was executed previously is selected; that is, let it be assumed that a load voltage output from the fixation unit 30 is selected. In the foregoing case, upon repeating step S4, when the status determination unit 86 sends, to the selection unit 84, a control signal for commanding selection of the load voltage received by the power receiving terminal P2*b*; that is, the load voltage output from the temperature sensor 60. In accordance with the foregoing command, the selection unit 84 selects the load voltage received by the power receiving terminal P2*b*, and outputs the selected load voltage to the voltage detection unit 85.

In the foregoing case, the voltage detection unit 85 detects, in step S5, a voltage value of the load voltage received by the power receiving terminal P2*b*; that is, the load voltage output from the temperature sensor 60, and outputs a detection signal indicating the detected voltage value to the status determination unit 86.

Subsequently, the status determination unit 86 determines, in step S6, that the connector 63 connected to the temperature sensor 60 is electrically connected, normally, to the connector 83*a* when the voltage value indicated by the detection signal output from the voltage detection unit 85 is within a predetermined range (temperature range) as a range in which the voltage value of the load voltage output from the temperature sensor 60 will change. Meanwhile, the status determination unit 86 determines that the connector 63 connected to the temperature sensor 60 is not electrically connected, normally, to the connector 83*a* when the voltage value indicated by the detection signal output from the voltage detection unit 85 is not within the foregoing predetermined range.

Note that, as described above, the range that the voltage value of the load voltage outputted from the temperature sensor 60 changes is predetermined, for example, according to the temperature range of the object to be detected by the temperature sensor 60 based on test results of test operations, and stored in a ROM or the like.

The communication interface unit 70 sends to the communicably connected external device 9, in step S7, a control signal indicating the determination result regarding whether the connector 63 connected to the temperature sensor 60 is electrically connected, normally, to the connector 83*b*, via the communication cable C2 connected to the communication cable connection unit 71.

Subsequently, in step S4, when there is no longer any load voltage that has not been selected by the selection unit 84 (S8; NO), the status determination unit 86 ends the operation of determining whether the connector connected to the load circuit is electrically connected, normally, to the connector corresponding to that load circuit in the control unit 80.

In other words, the status determination unit 86 causes the selection unit 84 to sequentially select a plurality of load voltages (step S4, step S8), and causes the voltage detection unit 85 to sequentially detect the sequentially selected load voltages (step S5). Subsequently, the status determination unit 86 sequentially determines whether the connector connected to the load circuit corresponding to the sequentially detected load voltages is electrically connected, normally, to the connector corresponding to that load circuit in the control unit 80 based on the sequentially detected load voltages (step S6).

Returning to FIG. 3, the external device 9 comprises, for example, a CPU, a ROM or an HDD for pre-storing various programs to be executed by the CPU and data required for such execution and the like, a readable and rewritable RAM for temporarily storing data, and peripheral circuits thereof. For example, the external device 9 is an information processing device such as a personal computer or a portable phone terminal device. The external device 9 comprises a display unit 91, a signal receiving unit 92, and a determination result display unit 93.

The display unit 91 is configured, for example, from a liquid crystal display, and displays various types of information related to the operation of the external device 9.

The signal receiving unit 92 is, for example, a communication interface circuit for performing wired communication using a communication cable such as a 10/100 Base-TX. The signal receiving unit 92 is connected to another end of the communication cable C2 in which the one end thereof (connector N2 (FIG. 3)) is connected to the communication cable connection unit 71 via the access part A2 of the packaging box 2. The signal receiving unit 92 receives the determination result of the status determination unit 86 that was sent by the communication interface unit 70 in foregoing step S7.

The CPU configures the determination result display unit 93 by executing the control program stored in the HDD or the like. When the signal receiving unit 92 receives the determination result of the status determination unit 86 that was sent by the communication interface unit 70 in foregoing step S7, the determination result display unit 93 displays, on the display unit 91, information according to the received determination result of the status determination unit 86.

Note that the information according to the determination result of the status determination unit 86 may be, for example, information which associates the name (for example, "fixation unit") for identifying the load circuit to be determined, and a symbol (for example, 0 when normal and 1 when not normal) indicating whether the connector connected to that load circuit is electrically connected, normally, to the connector corresponding to that load circuit in the control unit 80. Information according to the determination result of the status determination unit 86 is pre-stored in the ROM or the like by being associated with the information for identifying the control signal output from the status determination unit 86. The determination result display unit 93 displays, on the display unit 91, information according to the determination result of the status determination unit 86, which corresponds to the control signal received by the signal receiving unit 92, by using information which is pre-stored in the ROM or the like.

According to the foregoing embodiment, the connector N1 provided to one end of the power cable C1 can be connected to the power cable connection unit 81 via the access part A1 in a state where the color printer 1 is packaged with the packaging box 2. When the connector N1 provided to one end of the power cable C1 is connected to the power cable connection unit 81, a power supply voltage is generated by the power supply voltage generation unit 82, and the generated power supply voltage is supplied to the load circuits (fixation unit 30, temperature sensor 60) via the connectors 83*a*, 83*b*. In addition, whether the connection status of the load circuit, which is operated as a result of the power supply voltage being supplied thereto, is normal is determined by the status determination unit 86. The determination result is sent by the communication interface unit 70 to the external device 9 provided outside the packaged image forming apparatus 3.

Thus, in a state where the color printer 1 is packaged, it is possible to confirm whether the connection status of the circuit inside the color printer 1 is normal by using the external device 9 that is provided outside the packaged image forming apparatus 3.

Moreover, according to the foregoing embodiment, when the connector N1 provided to one end of the power cable C1 is connected to the power cable connection unit 81, a power supply voltage is generated by the power supply voltage generation unit 82, and the power supply voltage is supplied to the load circuits (fixation unit 30, temperature sensor 60) via the connectors 83*a*, 83*b* (step S2). In addition, when a load voltage according to the power supply voltage is output from the load circuit as a result of the power supply voltage being supplied, the load voltage is detected by the voltage detection unit 85 (step S5). In addition, whether the connectors 33, 63 connected to the load circuits are electrically connected, normally, to the connectors 83*a*, 83*b* is determined by the status determination unit 86 based on the detected load voltage (step S6). Subsequently, the determination result is sent by the communication interface unit 70 to the external device 9 provided outside the packaged image forming apparatus 3 (step S7).

Thus, in a state where the color printer 1 is packaged, it is possible to confirm whether the connectors 33, 63 connected to the load circuits (fixation unit 30, temperature sensor 60) are electrically connected, normally, to the connectors 83*a*, 83*b* using the external device 9 provided outside the packaged image forming apparatus 3. In other words, prior to performing the operation check of the color printer 1, in a state where the color printer 1 is packaged, it is possible to confirm in advance whether the connectors 33, 63 connected to the load circuits are electrically connected, normally, to the connectors 83*a*, 83*b*. Consequently, even when the connectors 33, 63 connected to the load circuits are no longer electrically connected, normally, to the connectors 83*a*, 83*b* during shipment, the operation of connecting the connectors 33, 63 connected to the load circuits to the connectors 83*a*, 83*b* can be performed quickly upon performing the operation check of the color printer 1. It is thereby possible to efficiently perform the operation check of the load circuits.

Moreover, according to the foregoing embodiment, by repeating step S4 to step S8, in a state where the color printer 1 is packaged, it is possible to determine, one by one in order, whether the connectors 33, 63 connected respectively to the plurality of load circuits (fixation unit 30, temperature sensor 60) provided to the color printer 1 are electrically connected, normally, to the connectors 83*a*, 83*b* corresponding to the respective load circuits.

Moreover, according to the foregoing embodiment, in a state where the switch unit 89 performs switching so that an electric current does not pass between the power receiving terminal P2*a* and the ground (step S3), it is determined whether the connector 33 connected to the fixation unit 30 is electrically connected, normally, to the connector 83*a* (step S6). Accordingly, in comparison to a case of determining whether the connector 33 connected to the fixation unit 30 is electrically connected, normally, to the connector 83*a* in a state of passing an electric current between the power receiving terminal P2*a* and the ground and flowing a current to the conductive heating element 31*a* (FIG. 3) of the fixation unit 30, it is possible to alleviate the possibility of the conductive heating element 31*a* generating heat as a result of a current flowing therethrough. It is thereby possible to more safely determine whether the connector 33 connected to the fixation unit 30 is electrically connected, normally, to the connector 83*a*.

Moreover, according to the foregoing embodiment, prior to performing the operation check of the color printer 1, in a state where the color printer 1 is packaged, it is possible to determine whether the connector 63 connected to the temperature sensor 60 is electrically connected, normally, to the connector 83*b*. Consequently, even when the connector 63 connected to the temperature sensor 60 is no longer electrically connected, normally, to the connector 83*b* during shipment, the operation of connecting the connector 63 connected to the temperature sensor 60 to the connector 83*b* can be performed quickly upon performing the operation check of the color printer 1. It is thereby possible to efficiently perform the operation check of the temperature sensor 60.

Moreover, according to the foregoing embodiment, in a state where the color printer 1 is packaged, it is possible to easily comprehend, based on information according to the determination result displayed on the display unit 91 of the external device 9, the determination result of whether the connectors 33, 63 connected to the load circuits (fixation unit 30, temperature sensor 60) inside the packaged color printer 1 are electrically connected, normally, to the connectors 83*a*, 83*b*.

Note that the configuration and the like shown in FIG. 1 to FIG. 4 are merely exemplifications of an embodiment according to the present disclosure, and are not intended to limit the present disclosure to such embodiment.

For example, the status determination unit 86 may also determine whether the connection status of the RAM 87 is normal by executing step S2 (FIG. 4), and thereafter further writing predetermined verification information such as predetermined text data in the RAM 87 (FIG. 3) and thereafter determining whether the information read from the RAM 87 coincides with the written verification information.

In the foregoing case, prior to performing the operation check of the color printer 1, it is possible to confirm in advance whether the connection status of the RAM 87 is normal in a state where the color printer 1 is packaged. Consequently, even when the RAM 87 is no longer normally connected during shipment, the operation of re-inserting the RAM 87 into the memory slot 88 or the operation of replacing the RAM 87 for causing the RAM 87 to operate normally can be performed quickly upon performing the operation check of the color printer 1. It is thereby possible to efficiently perform the operation check of the RAM 87.

Moreover, the RAM 87 includes a storage area that is identified by a plurality of predetermined successive addresses. Thus, the status determination unit 86 may also write predetermined verification information (first verification information) such as a numerical value in the storage area corresponding to the leading address among the plurality of predetermined successive addresses in the RAM 87. Subsequently, the status determination unit 86 may read information from the storage area corresponding to the leading address and determine whether the read information coincides with the previously written verification information. Coincidentally, the status determination unit 86 may also write predetermined verification information (second verification information) such as a numerical value in the storage area corresponding to the terminal address in the RAM 87. Subsequently, the status determination unit 86 may read information from the storage area corresponding to the terminal address and determine whether the read information coincides with the previously written verification information. Subsequently, the status determination unit 86 may determine that the connection status of the RAM 87 is normal upon determining that, in the two determination processes described above, the information read from the storage area coincides with the previously written verification information.

In the foregoing case, whether the connection status of the RAM 87 is normal is determined by twice accessing, through writing and reading, the two storage areas in the RAM 87; that is, by accessing the RAM 87 four times. Thus, the number of times that the RAM 87 is accessed can be decreased in comparison to the case of determining whether the connection status of the RAM 87 is normal by writing predetermined verification information in all of the storage areas corresponding to the plurality of predetermined successive addresses configuring the RAM 87, and thereafter determining whether it was possible to read each piece of information which coincides with the written verification information. It is thereby possible to more quickly determine whether the connection status of the RAM 87 is normal.

Moreover, in the foregoing embodiment, an example of applying the image forming apparatus of the present disclosure to the color printer 1 was explained. However, the present disclosure can also be applied to a copy machine, a scanning device, a facsimile machine, or the like.

Moreover, the configuration can be simplified by omitting the switch unit 89 (FIG. 3) or omitting step S3 (FIG. 4).

Moreover, the communication interface unit 70 and the signal receiving unit 92 may also be a communication interface circuit which performs wireless communication via Wi-Fi (Wireless fidelity (registered trademark)) or Bluetooth (registered trademark). In the foregoing case, the configuration may be simplified by omitting the communication cable connection unit 71 and the access part A2.

Moreover, the control unit 80 may also be configured to comprise only one connector. Consequently, the configuration may be simplified by omitting the selection unit 84 and omitting step S4 and step S8. In the foregoing case, in step S5, the voltage detection unit 85 detects the voltage value of the load voltage received by the power receiving terminal of the one connector, and outputs a detection signal indicating the detected voltage value to the status determination unit 86.

Moreover, the configuration can be simplified by omitting the temperature sensor 60 and the connector 83*b*.

According to the present disclosure as described above, the operation check of the image forming apparatus can be performed with the image forming apparatus in a packaged state.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A diagnostic system of an apparatus to be packaged, comprising:

a packaged image forming apparatus and an external device provided outside the packaged image forming apparatus, the packaged image forming apparatus including:

a fixation unit that performs fixation processing to a paper including a toner image via heating, the fixation unit including:

a heat roller that heats the paper during the fixation processing, and a conductive heating element mounted inside the heat roller and generating heat as a result of a current flowing therethrough;

a power supply connection unit to which one end of a power cable, the other end of which is connected to an external power source, is detachably connected;

a single power supply voltage generation unit receiving a voltage supplied from the external power source via the power cable connected to the power supply connection unit and generating a power supply voltage;

a first load circuit supplied with the power supply voltage and outputting a first load voltage according to the power supply voltage;

a second load circuit supplied with the power supply voltage and outputting a second load voltage according to the power supply voltage;

a first main body-side connector detachably connected to a connector connected to the first load circuit, the first main body-side connector including:

a first power feeding terminal supplying the power supply voltage generated by the power supply voltage generation unit to the first load circuit, and a first power receiving terminal receiving the first load voltage output from the first load circuit;

a second main body-side connector to which a connector connected to the second load circuit is detachably connected, the second main body-side connector including a second power feeding terminal supplying the power supply voltage generated by the power supply voltage generation unit to the second load circuit, and a second power receiving terminal receiving the second load voltage output from the second load circuit;

a single voltage detection unit detecting the first load voltage received by the first power receiving terminal and the second load voltage received by the second power receiving terminal;

a switch unit having a first terminal connected to the first power receiving terminal and a second terminal connected to a ground for switching between whether or not to pass an electric current between the first power receiving terminal and the ground;

a status determination unit sending a control signal to the switch unit for performing switching so that an electric current does not pass between the first power receiving terminal and the ground when the power supply voltage generation unit starts the generation of the power supply voltage and starts determination about whether a connection status of the first load circuit and the second load circuit is normal after the switch unit performs switching so that an electric current does not pass between the first power receiving terminal and the ground based on the control signal;

a communication interface unit for sending a determination result of the status determination unit to the external device;

a resistance having one end connected to the second power receiving terminal and another end connected to the ground; and a selection unit connected to a first wiring connecting the first power receiving terminal and the first terminal of the switch unit and connected to a second wiring connecting the second power receiving terminal and the one end of the resistance and selecting one of the first load voltage applied to the first wiring and received by the first power receiving terminal and the second load voltage applied to the second wiring and received by the second power receiving terminal and outputting the selected load voltage to the voltage detection unit, wherein:

the voltage detection unit detects a load voltage inputted from the selection unit, the status determination unit causes the selection unit to sequentially select the first load voltage and the second load voltage, causes the voltage detection unit to sequentially detect the sequentially selected load voltages and sequentially determines, based on the sequentially detected load voltages, whether a connector connected to a load circuit corresponding to one of the sequentially detected load voltages is electrically connected normally to a main body-side connector corresponding to that load circuit, the first load circuit is the conductive heating element, the first power receiving terminal is connected to one end on the ground side of the conductive heating element, and the status determination unit determines that the connector connected to the first load circuit is electrically connected normally to the first main body-side connector when a voltage value of the first load voltage detected by the voltage detection unit exceeds a predetermined voltage value; and a packaging member packaging the image forming apparatus, the packaging member includes:

an access part enabling the one end of the power cable to be connected to the power supply connection unit in a state where the image forming apparatus is packaged, and the external device including:

a display unit displaying information, a signal receiving unit receiving a determination result of the status determination unit sent from the communication interface unit, and a determination result display unit causing the display unit to display information according to the determination result of the status determination unit received by the signal receiving unit.

2. The diagnostic system of an apparatus to be packaged according to claim 1, wherein the image forming apparatus further comprises:

a temperature detection unit detecting a temperature within the image forming apparatus, wherein the second load circuit is the temperature detection unit, the temperature detection unit changes the second load voltage within a predetermined temperature range according to the detected temperature based on the power supply voltage, and the status determination unit determines that the connector connected to the second load circuit is electrically connected normally to the second main body-side connector when the second load voltage detected by the voltage detection unit is a voltage corresponding to a voltage within the temperature range.

3. The diagnostic system of an apparatus to be packaged according to claim 1, wherein the image forming apparatus further comprises:

a memory capable of reading and writing information, wherein the status determination unit determines whether a connection status of the memory is normal when predetermined verification information is written in the memory and thereafter determination is made that the information read from the memory coincides with the verification information.

4. The diagnostic system of and apparatus to be packaged according to claim 3, wherein the memory is configured from a plurality of predetermined successive storage areas, and the status determination unit determines whether a connection status of the memory is normal when first verification information is written in a leading storage area among the plurality of storage areas and thereafter determination is made that information read from the leading storage area coincides with the first verification information, and at the same time when second verification information is written in a terminal storage area among the plurality of storage areas and thereafter determination is made that information read from the terminal storage area coincides with the second verification information.

5. The diagnostic system of an apparatus to be packaged according to claim 1, wherein:

the information according to the determination result of the status determination unit is information that associates a name for identifying the load circuit to be determined by the status determination unit and a symbol indicating whether the load circuit is connected normally.

* * * * *